United States Patent [19]

Asen

[11] 4,074,102

[45] Feb. 14, 1978

[54] MICROWAVE OVEN RACK

[76] Inventor: Donald Asen, 114 Cornell Ave., Bala Cynwyd, Pa. 19004

[21] Appl. No.: 665,721

[22] Filed: Mar. 10, 1976

[51] Int. Cl.[2] ..... H05B 9/06

[52] U.S. Cl. ..... 219/10.55 E; 99/426

[58] Field of Search ..... 219/10.55 E, 10.55 R, 219/10.55 F, 10.71; 99/422, 426, 428, 447, 448, 449, 450, DIG. 14

[56] References Cited

U.S. PATENT DOCUMENTS

| | | | |
|---|---|---|---|
| 1,962,908 | 6/1934 | Pierson | 99/450 X |
| 2,056,109 | 9/1936 | Morris | 99/426 |
| 2,360,026 | 10/1944 | Wall | 99/426 |
| 3,230,864 | 1/1966 | Krajewski | 219/10.55 E X |
| 3,405,631 | 10/1968 | Thomas, Jr. | 99/426 |
| 3,946,187 | 3/1976 | MacMaster et al. | 219/10.55 E |
| 3,994,212 | 10/1976 | Wong | 219/10.55 E X |

*Primary Examiner*—Arthur T. Grimley
*Attorney, Agent, or Firm*—Weiser, Stapler & Spivak

[57] ABSTRACT

A microwave oven rack comprising a base rack or grid fabricated with a plurality of spaced ribs. Feet are provided to raise the rack above an oven pan to provide a clearance space therebelow. A plurality of holders each having a clip portion and an upright arm may be affixed to the ribs by applying the clip portions to the ribs in any of a plurality of spaced positions. The holders are positioned on the ribs to hold the object to be cooked in a desired position upon the top surface of the rack.

29 Claims, 9 Drawing Figures

MICROWAVE OVEN RACK

BACKGROUND OF THE INVENTION

This invention relates generally to the field of microwave cooking, and more particularly, is directed to a plastic oven rack construction to hold food in a desired position for cooking.

In the microwave cooking art, it is well known that microwave energy can be successfully used in the preparation and cooking of various kinds of foods. It has been found that conventional metallic oven pans and oven racks are unsuitable for use within microwave cooking ovens. Such metallic parts, when subject to microwave energy, can become hot enough to actually burn food in contact with the metal rather than to permit even cooking throughout. Because of this, it is now common practice to employ materials other than metal for holding food within the microwave oven for food cooking purposes. Such non-metallic materials which are unaffected by microwave energy can be safely employed within the oven interior in that the materials will not be heated or otherwise affected by the microwaves. The food being cooked absorbs the microwave energy and there is no tendency to melt, burn or otherwise deteriorate the nonmetallic cooking utensils themselves.

In view of this relatively new form of cooking energy, prior workers in the art have yet to develop a suitable method and apparatus for holding large food stuffs in a desired position for microwave cooking. Conventionally, when utilizing electric and gas heated ovens, large foods such as roasts, poultry and other large meats are normally placed within a metallic rack that is adjustable to a degree to accommodate the food. The rack with the meat secured therein is placed into an oven pan to catch the drippings during the baking or roasting procedures. In the case of microwave ovens, suitable, comparable, plastic utensils have not as yet been developed and to date, there is no apparatus available to adjustably hold large food stuffs such as roasts, turkeys, and other large meat products within the oven in a manner to assure overall cooking. Certain types of microwave cooking apparatus has been disclosed by prior workers in the art in U.S. Pat. Nos. 2,997, 566, 3,591,751, 3,789,178, 3,810,248, 2,961,520, 2,912,554, 3,662,141, 3,230,864. However, all of these prior art microwave cooking appliances do not employ or teach a plastic grid base rack or the use of plastic holders which can clip to the plastic rack or grid to permit easy space adjustments to hold meat or other foods in a desired position for cooking.

SUMMARY OF THE INVENTION

This invention relates generally to apparatus for cooking foods, especially large meats and poultry with microwave energy in a microwave oven and more particularly, is directed to a grid type base to which a plurality of upright food holders can clip at any desired location.

The microwave oven roasting rack of the present invention comprises a rectangular or other shaped rack or grid having a pair of spaced headers between which extend a plurality of parallel ribs which preferably are equally spaced. The rack may be fabricated of any material having a sufficient rigidity for the purpose and which is unaffected by the microwave energy generated within microwave ovens. It is contemplated that the rack can be molded or otherwise formed of a plastic or other material not affected by microwave energy, such as styrene, acrylic, polyethylene, polypropylene, etc. in an efficient and relatively inexpensive manner. It is further contemplated that an oven rack of the same general design as herein set forth could also be employed within an electric or gas oven by simply constructing the parts of materials resistant to the heat of such ovens. Metallic parts could be suitably formed and used for this purpose.

A plurality of adjustable plastic meat holders are utilized in conjunction with the rack or grid and each holder comprises an upright meat holding arm and a bottom clip portion for contacting and securing to a rib. It is contemplated that the clip portions of the various meat holders can be placed on any rib in any longitudinal spaced position. The meat holders will be self supporting in any desired position and will cooperatively hold the food stuffs to be cooked. Thus, wide lateral adjustment to accommodate any width of meat can be readily accomplished by placing the holders on ribs of the base rack which are more widely spaced apart. Longitudinal adjustment can be also readily accomplished by simply moving the holders longitudinal along their respective associated ribs until the desired longitudinal position is achieved.

As herein employed, the word plastic is defined to mean any synthetic or natural material that will not absorb or will be otherwise unaffected by microwave energy including but not limited to plastics such as styrene, acrylic, polyethylene, polypropylene, various ceramic materials, heat resistant glass and wood.

It is therefore an object of the present invention to provide an improved oven rack of the type set forth.

It is another object of the present invention to provide a novel microwave oven rack comprising a grid, a plurality of plastic ribs and a plurality of plastic holders which may be associated with the ribs in a wide variety of positions to accommodate foods of various sizes and configurations.

It is another object of the present invention to provide a novel microwave oven rack incorporating a bottom grid of parallel, spaced ribs and a plurality of plastic meat holders which can be clipped to the ribs in readily adjustable manner in an infinite number of positions.

It is another object of the present invention to provide a novel oven rack comprising grid base means and holder clip means which may be adjustably affixed to the grid means to provide a plurality of upright meat holders in an infinite number of positions upon the grid means.

It is another object of the present invention to provide a novel microwave oven rack which is fabricated of plastic interfitting members which are relatively adjustable to secure bulky food stuffs in a desired position during cooking operations within the microwave oven.

It is another object of the present invention to provide a novel microwave oven rack that is rugged in construction, inexpensive in manufacture and trouble free when in use.

Other objects and a fuller understanding of the invention will be had by referring to the following description and claims of a preferred embodiment thereof, taken in conjunction with the accompanying drawings, wherein like reference characters have been employed to refer to similar parts throughout the several views and in which:

DESCRIPTION OF THE PREFERRED EMBODIMENT OF THE INVENTION

Figure 1:
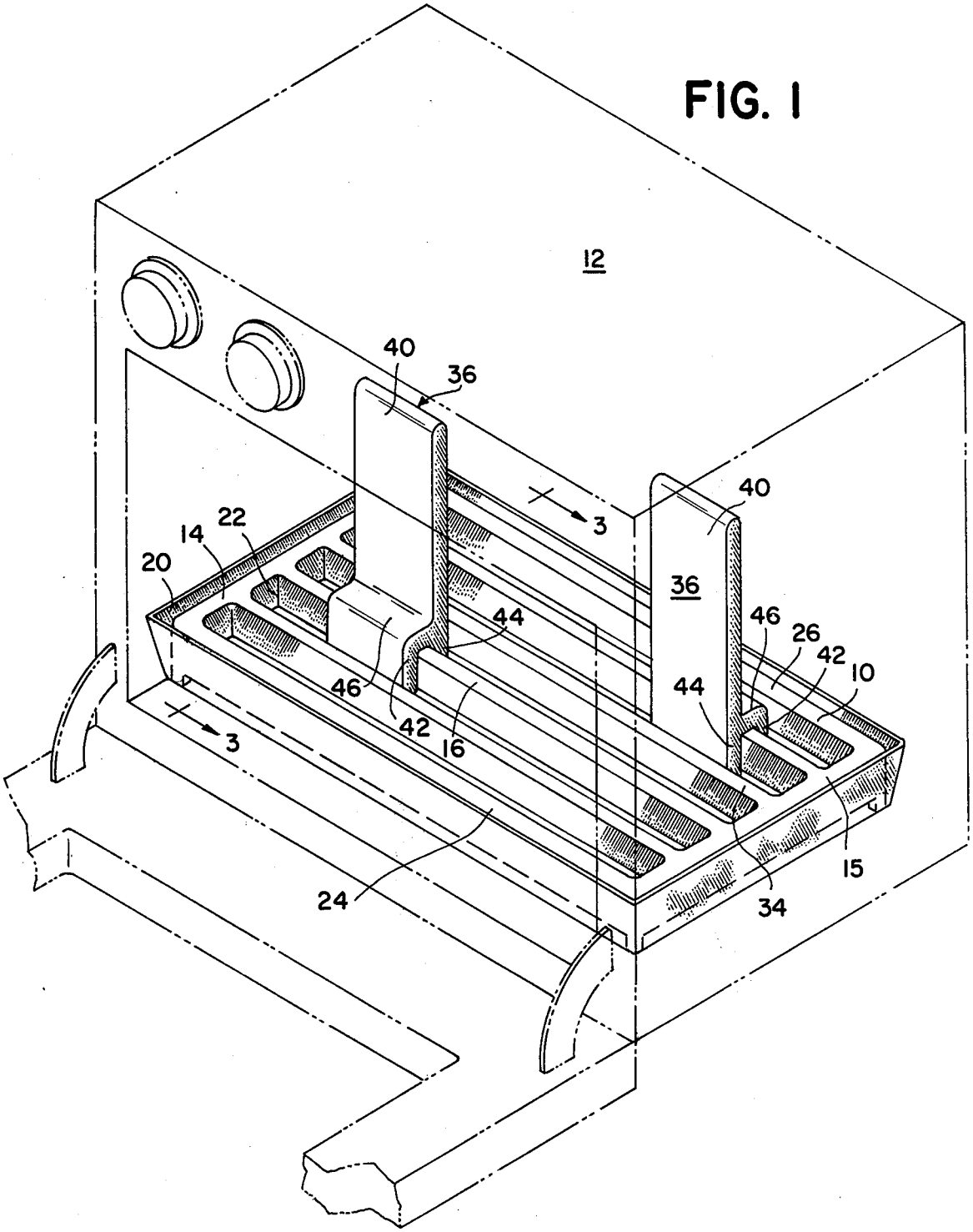
FIG. 1 is an isometric view of a microwave oven rack constructed in accordance with the present invention in use within a microwave oven.

Although specific terms are used in the following description for the sake of clarity, these terms are intended to refer only to the particular structure of the invention selected for illustration in the drawings, and are not intended to define or limit the scope of the invention.

Figure 2:
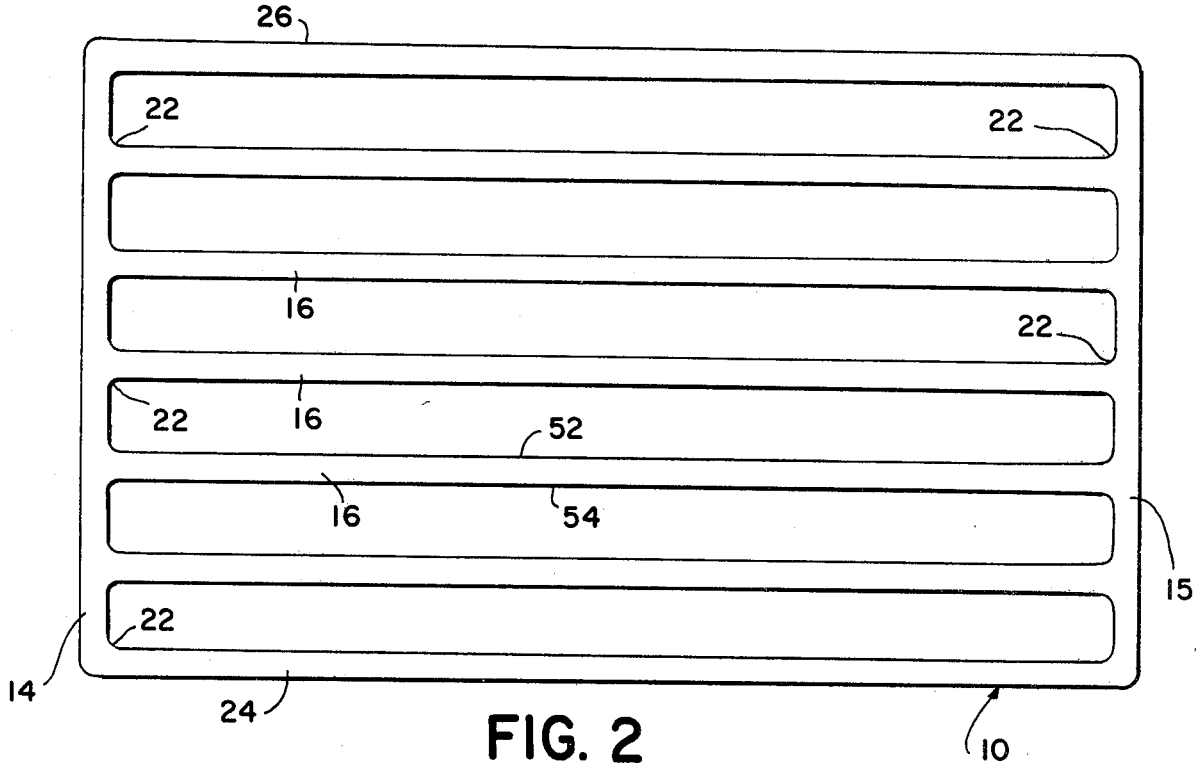
FIG. 2 is a top plan view of the microwave oven rack grid.
Figure 3:
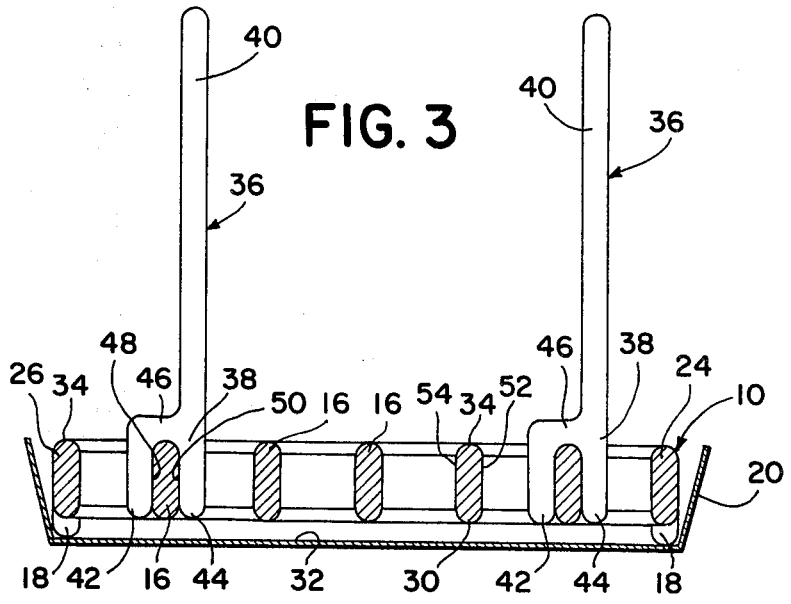
FIG. 3 is a cross sectional view taken along Line 3—3 of FIG. 1, looking in the direction of the arrows.

Referring now to the drawings, there is shown in FIGS. 1, 2 and 3, an oven rack generally designated 10 in use within an oven 12 which may be a microwave type of oven. The oven rack or grid 10 is preferably fabricated of a material that is unaffected by microwave energy within a microwave oven 12 such as various types of plastics. The oven rack 10 may be fabricated of a molded or otherwise formed material which will not absorb sufficient microwave energy to absorb and cause excessive heat, such as styrene, acrylic, polyethylene, polypropylene or other materials suitable for the use. Materials suitable for the purpose have herein been generally defined as "plastics." It is further contemplated that the oven rack or grid 10 can be fabricated of a heat resistant material for use as an oven rack within conventional gas or electric ovens. Any materials that will be permanently unaffected by the usual temperatures encountered within such gas or electric ovens which may be formed or shaped to form a plurality of juxtaposed ribs or a plurality of openings or slots could be employed for this purpose.

As illustrated in FIGS. 1 and 3, the oven rack 10 of the present invention is normally used in conjunction with an oven pan 20 and is placed therein during the food cooking process. In this manner, any drippings, fat, basting or other liquids normally encountered in the cooking processes will be retained within the oven pan 20 in conventional manner. The rack or base 10 and the oven pan 20 are shown in generally transverse orientation for the purposes of illustration only. It will be appreciated that the rack 10 could be longitudinally oriented or angularly arranged relative to the oven 12 and still fall within the meaning and intent of this invention.

As best seen in FIGS. 2 and 3, the oven rack 10 is formed as a base grid or rack for meat or other food holding purposes while cooking. Each oven rack 10 comprises a plurality of transversely extending, spaced, parallel ribs 16. The ribs extend across the rack from the left header 14 to the right header 15, which headers define the transverse extremities of the rack 10. The forward extension of the rack 10 is defined by a front rib 24 and the rearward extension of the rack 10 is defined by the rearward rib 26. It is contemplated that all of the ribs 16, 24, 26 will be similar in size and configuration to form a neat appearing, easily usable rack. However, it is also contemplated that the ribs 16, 24, 26 could be formed of different sizes or of different shapes and still come within the meaning and intent of this invention.

In the embodiment illustrated, the headers 14, 15 and the front and rear ribs 24, 26 define an oven rack or grid 10 which is of rectangular configuration. The oven rack 10 may be of other than rectangular configuration, if so desired, of size and configuration to easily fit within the oven 12 and to hold food of any particular configuration.

Each of the ribs 16, 24, 26 joins the left and right transverse headers 14, 15 in junctions 22 which preferably are integrally formed. It will be appreciated, however, that the junctions 22 may be made in several well known manners by those skilled in the art, such as by molding, gluing, welding or otherwise, to provide a relatively strong, easily manufactured oven grid 10. A plurality of feet 18 or other projections affix to the bottom surfaces of at least some of the ribs 16, 24, 26 to project below a plane drawn through the bottom extremities 30 of the various ribs 16, 24, 26. As illustrated in FIG. 3, the feet 18 contact the bottom 32 of the oven pan 20 to thereby raise the bottoms 30 of the various ribs above the bottom surface 32 of the oven pan 20 a distance equal to the height of the feet 18 to allow full drainage of the cooking juices (not shown). Preferably, the respective tops 34 of the ribs 16, 24, 26 all terminate substantially in a horizontal plane to act as a multisurface support for the food (not shown) being cooked within the oven 12 when the oven rack 10 is employed.

Referring now to FIGS. 1 and 3, there are shown a plurality of holders 36 which are generally of inverted Y-shaped configuration for food holding purposes in the manner hereinafter more fully set forth. The plurality of food holders 36 are similarly formed and each generally comprises a clip portion 38 and an upright arm portion 40 which extends above the clip portion 38. The clip portion 38 comprises a front leg 42 and a rear leg 44 which is spaced from the front leg 42 by a web 46 of width equal to the width of a rib 16, 24, 26. The front and rear legs 42, 44 of the food holders 36 extend downwardly in length a distance approximately equal to the height of the ribs 16, 24, 26 to form a firm connection when the clip portion 38 is applied to a rib 16, 24, or 26. As illustrated, the food holders 36 may be conveniently applied to any rib 16, 24, 26 by applying the front and rear legs 42, 44 of each food holder 36 on each side of a rib and then pushing downwardly so that the inwardly facing sides 48, 50 of the legs 42, 44 contact respective sides 52, 54 of the associated rib. The food holder 36 is fully applied to a rib 16, 24, 26 by pushing downwardly until the lower surface of the web 46 contacts the top surface 34 of the associated rib. The food holders 36 are fabricated of sufficient length to provide a firm support when mounted upon a rib and sufficient holders, for example, four or more are employed as required to fully support the food being cooked.

It is noteworthy that in the embodiment illustrated, the upright arm 40 of each food holder 36 extends upwardly above the web 46 a sufficient distance for food holding purposes. In a preferred embodiment, the upright arm 40 aligns in the same vertical plane as its associated rear leg 44 of the clip portion 38 to define the back of the Y-shaped configuration previously set forth. It is noteworthy that the front to rear spacing between food holders 36 may be varied in several manners, depending on the distances desired. By placing the clip portions 38 of at least two holders on different ribs 16, 24, or 26 a wide range of adjustment is possible. Relatively fine adjustment can be made between food holders 36 which are mounted on different ribs by varying the forward or rearward orientation of the respective web sections 46 and at the same time, maintaining association with the same ribs.

As illustrated in FIG. 3, the web sections 46 can be oriented to extend in the same direction to thereby define a spacing between the respective upright arms 40 that is a direct function of the spacing between the respective ribs 16 employed for the food holder securing purpose. As seen in FIG. 1, the respective webs 46 can be positioned to face in opposite directions to thereby vary the distance between the respective upright arms 40 by the thicknesses of the respective webs 46. The webs 46 could also be arranged to extend toward each other (not illustrated). Thus, an extremely wide range of adjustment can be possible by judiciously placing the food holders 36 on the oven rack or grid 10. Initially, a relatively crude adjustment can be made by placing the food holders 36 on desired, spaced apart ribs 16, 24, or 26. Once the rough adjustment is decided upon as determined by the size and configuration of the food being cooked, the spacing between the upright arms 40 can be varied either by placing the food holders so that the webs 46 respectively face each other, face away from each other, or one face toward and the other face away from the other.

In use, the food to be cooked such as a turkey or a roast is placed upon the respective top surfaces 34 or the various ribs 16, 24, 26. It is contemplated that in most instances, a plurality of four food holders 36 will be utilized in conjunction with the food (not shown) being cooked. The holders 36 can be placed upon the ribs in any of a wide range of locations which can be tailored as above set forth to conform to the configuration of the poultry, roast or other food being cooked within the oven 12. It is noteworthy that meat of irregular configuration can be readily accommodated by varying, for example, the spacing between a pair of food holders 36 placed near the right header 15 and also varying the spacing between a pair of cooperating food holders 36 which may be positioned near the left header 14. The spacing may be varied within wide ranges to accommodate the configuration of the particular food to be cooked within the oven 12.

In the case of microwave cooking, it is contemplated that the food holders 36 will be molded or otherwise fabricated of the same type of plastic materials employed in the fabrication of the rack or grid 10 itself. However, it is also within the scope and intent of this invention to fabricate the food holders 36 of a different type of plastic than the plastic employed for the rack 10 if so desired; the pertinent design parameter being that the material employed be unaffected by microwave energy. In the case of conventional electric or gas ovens, the food holders 36 may be fabricated of metal or other materials not subject to deformation or other injury when subjected to heat.

In a preferred embodiment, all surfaces are rounded for example, to a 0.125 inch radius to enhance the appearance of the apparatus and also to facilitate cleaning of the apparatus after use. In a preferred embodiment, it is contemplated that the oven rack 10 will be constructed to approximately 10.75 inches in width by approximately 6.25 inches in depth to form an oven rack of generally rectangular configuration to readily fit within the usual oven 12. Each rib 16, 24, 26 is preferably fabricated to a height of approximately 0.75 inches and of a thickness of approximately 0.25 inches. The interior distance between the front and rear legs 42, 44 of the food holders 36 is preferably fabricated to a dimension of approximately 0.26 inches to snugly overfit the various ribs in a secure manner.

Figure 4:
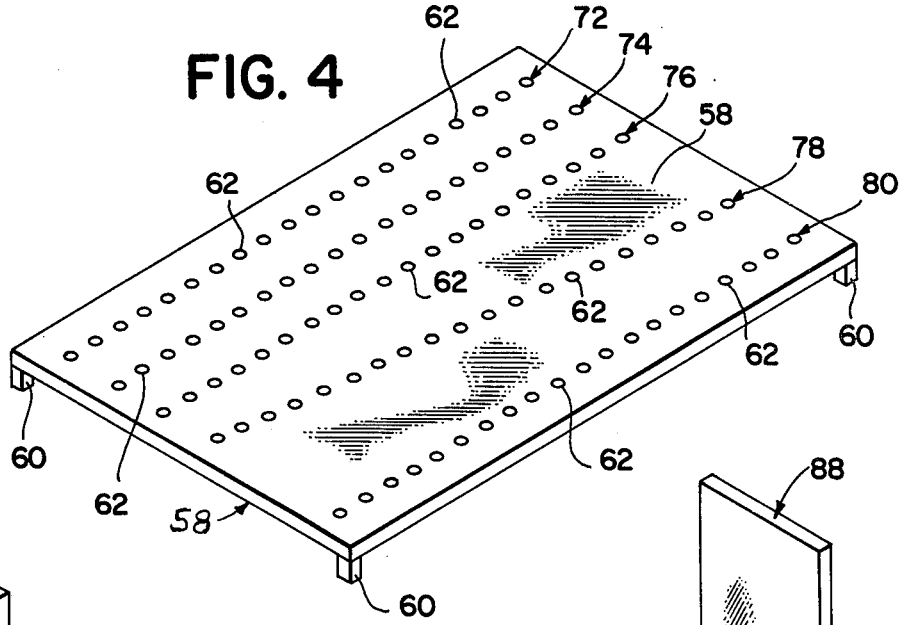
FIG. 4 is an isometric view of a modified oven rack or base.
Figure 5:
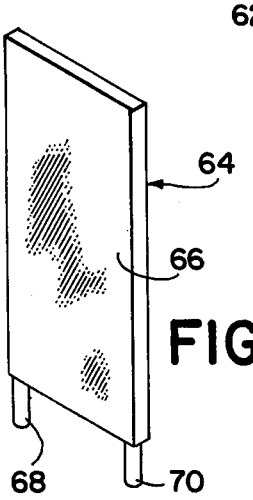
FIG. 5 is an isometric view of a modified food holder.

As shown in FIG. 4, the oven rack or base may be fabricated in the configuration of a generally planar member 58 which could conventionally be elevated from an oven pan 20 by a plurality of supporting feet 60 which may be integral with the member 58. A plurality of openings 62 can be drilled or otherwise provided through the member 58 to serve the dual purposes of receiving and supporting the modified food holders 64 (FIG. 5) and also to permit drainage of the juices and other liquids (not shown) which may be produced in the food cooking procedures. The modified food holder 64 is fabricated with a generally planar, upright body portion of sufficient height to support the food to be cooked. The body portion terminates downwardly in a pair of spaced feet 68, 70 which are so sized and spaced apart as to removably insert into pairs of holes 62 in the planar member 58.

As illustrated in FIG. 4, the holes 62 are spaced apart to receive the feet 68, 70 of the food holders 64 to support food holder in upright position for food securing purposes. The holes 62 and the feet 68, 70 are sized to snugly interfit and may be round, square or other cross sectional configuration.

The holes 62 are preferably arranged in rows 72, 74, 76, 78, 80 to conveniently receive the modified food holders 64. As illustrated, the rows 72, 74, 76 are parallel and equally spaced. The row 80 is parallel and unequally spaced. The row 78 is non-parallel. The row arrangement is for illustrative purposes only. It will be appreciated that those skilled in the art can alter the position of the holes 62 for maximum efficiency in a variety of manners to provide a plurality of food holding arrangements.

Figure 7:
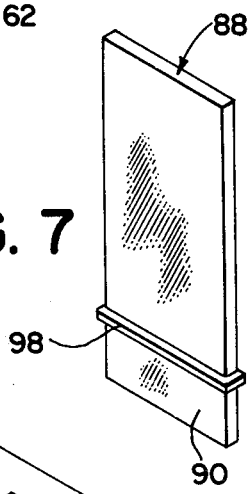
FIG. 7 is an isometric view of a second modified food holder.
Figure 6:
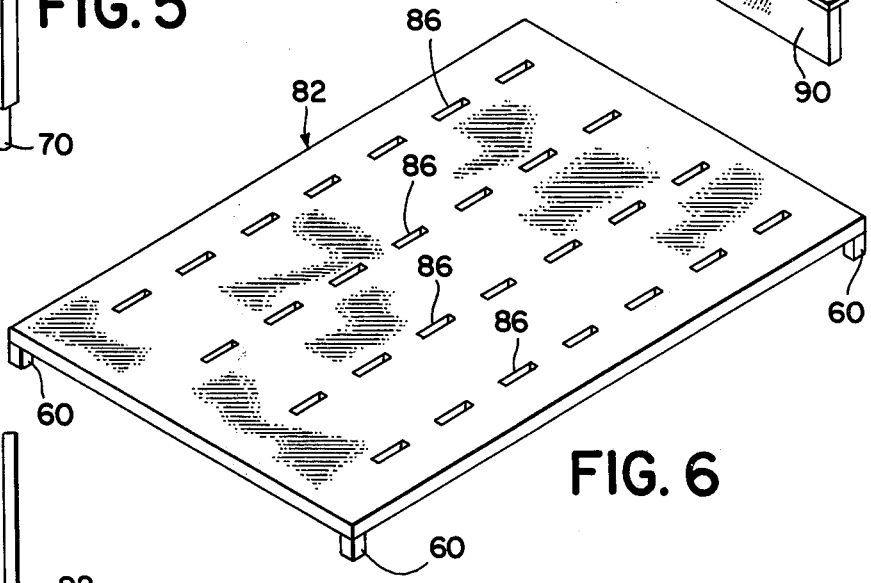
FIG. 6 is an isometric view of a second modified oven rack or base.
Figure 8:
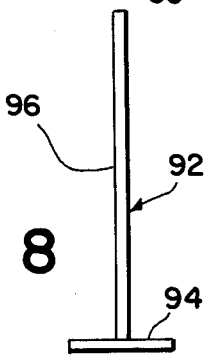
FIG. 8 is an isometric view of a third modified food holder.

Referring now to FIGS. 6 and 7, there is illustrated a second modified oven rack or base 82 which is planar in configuration and which is provided with feet 60 for elevational purposes. A plurality of slots 86 are provided through the rack 82 and the slots may be arranged in rows as illustrated or otherwise. The slots 86 are sized to snugly receive and removably hold the modified food holders 88. The food holders 88 are preferably formed to a planar configuration having at least one end 90 of size and configuration to fit within the slots 86 for food holding purposes.

It is further contemplated that a relatively flat, planar base such as illustrated in FIGS. 4 and 6 could be fabricated of either magnetic or magnetic attractive materials for use within either microwave ovens or gas or electric ovens. In the case of microwave ovens, the material should be unaffected by microwave energy. A suitable magnetic ceramic material could be utilized for this purpose. A cooperating modified food holder 92 would then be employed in conjunction with the planar surface 58 or 82. The food holder 92 comprises a base 94 and an upright food holding arm 96 for holding food in the manner herein set forth. The base 94 can be either of magnetic materials or magnetically attractive materials to cooperate with the materials employed in the base. Thus, by placing several of the holders 92 upon a planar base in the desired positions, magnetic attraction between the base and the holders will maintain the holders as placed for food holding purposes. In this embodiment, the holes 62 or slots 86 would be employed only for drainage purposes, and not for supporting the food holders 92.

In use, a sufficient number, for example four, food holders 36, 64, 88, 92 are employed to adequately support the food (not shown) during the cooking process. The plurality of holders 36, 64 or 88, 92 are applied to the respective racks or bases 10, 58 or 82 in the manner hereinbefore set forth to securely hold the food. The arrangements illustrated provide a wide range of adjustability of the food holders in relation to the associated base as may be dictated or required by the size and configuration of the food to be cooked.

Figure 9:
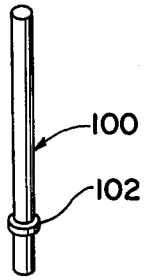
FIG. 9 is an isometric view of a fourth modified food holder.

In FIG. 9 there is illustrated a fourth modified food holder 100 which is suitable for use with the planar member 58 as illustrated in FIG. 4. The lower section of the food holder 11 can be readily inserted into any of the openings 62 and can be thereby retained in upright position. A collar 102 prevents the holder 100 from slipping completely through the planar member 58. A sufficient number of holders 100 should be employed and should be so positioned as required to retain the food to be cooked in the desired position.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. In an oven rack for use in holding food in a microwave oven, the combination of a non-metallic base, said base comprising means to support a plurality of food holding means; and a plurality of non-metallic food holding means adjustably carried by the base to hold the food, at least some of said food holding means comprising a food contacting arm which projects above the base to support food to be cooked in a desired position.

2. The oven rack of claim 1 wherein the base comprises a plurality of ribs, said ribs being interconnected at their extremities by a header and wherein at least some of said food holding means contact ribs.

3. The oven rack of claim 2 wherein at least some of the ribs are parallel.

4. The oven rack of claim 2 wherein at least some of the ribs are equally spaced apart.

5. The over rack of claim 2 wherein at least some of said holding means comprise a clip portion, said clip portion being adapted to secure the food holding means to a rib.

6. The oven rack of claim 2 wherein the ribs are of equal thickness and comprise generally parallel sidewalls whereby the food holding means can be secured to ribs.

7. The oven rack of claim 2 wherein the ribs are of equal thickness and height.

8. The oven rack of claim 1 and supporting feet means projecting below the base to support the base in a position above a surface.

9. The oven rack of claim 1 wherein at least some of the food holding means comprise a clip portion, the said clip portion adapted to engage the outer periphery of a portion of the base.

10. The oven rack of claim 2 wherein at least some of the food holding means comprise a clip portion, the said clip portion being adapted to engage an exterior peripheral portion of a rib.

11. The oven rack of claim 10 wherein the clip portion comprises a front leg and a rear leg, the front and rear legs defining a space therebetween, the said space being substantially equal to the thickness of a rib whereby the legs of the clip portion contact and clip the food holding means exteriorly to a rib.

12. The oven rack of claim 11 wherein the food holding means removably affix to a rib by contacting the front and rear legs.

13. The oven rack of claim 2 wherein at least some of the food holding means comprise a clip portion having a front leg and a rear leg and wherein the food contacting arm is coplanar with one of said legs.

14. The oven rack of claim 13 wherein the front and rear legs are spaced apart by a web to define an interior space therebetween.

15. The oven rack of claim 14 wherein the space is substantially equal to the thickness of a rib.

16. The oven rack of claim 15 wherein the front and rear legs depend from the web a distance substantially equal to the height of a rib.

17. The oven rack of claim 11 wherein the rib comprises parallel sidewalls and the food holding means removably affix to a rib by contacting the rib sidewalls respectively by the front and rear legs.

18. The oven rack of claim 17 wherein at least some of the openings are arranged in rows.

19. The oven rack of claim 18 wherein at least some of the rows are parallel.

20. The oven rack of claim 18 wherein at least some of the rows are non parallel.

21. The oven rack of claim 17 wherein at least some of the openings are equally spaced.

22. The oven rack of claim 17 wherein at least some of the openings are unequally spaced.

23. The oven rack of claim 17 wherein the said portions comprise insertable portions, said insertable portions being removably insertable into at least some of said openings.

24. The oven rack of claim 23 wherein at least some of the insertable portions comprise spaced feet, said feet being insertable into some of said openings.

25. The oven rack of claim 17 wherein at least some of the openings comprise elongated slots.

26. The oven rack of claim 25 wherein the said portions comprise insertable portions, said insertable portions being removably insertable into at least some of said slots.

27. The oven rack of claim 26 wherein the bottom of the insertable portion is substantially flat.

28. The oven rack of claim 1 wherein at least some of the food holding means are inverted Y-shaped in configuration.

29. The oven rack of claim 1 wherein at least some of the food holding means are I-shaped in configuration.

* * * * *